US007156078B1

(12) United States Patent
Furuta

(10) Patent No.: US 7,156,078 B1
(45) Date of Patent: Jan. 2, 2007

(54) FUEL INJECTION CONTROL DEVICE

(75) Inventor: Akira Furuta, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/374,159

(22) Filed: Mar. 14, 2006

(30) Foreign Application Priority Data

Nov. 16, 2005 (JP) ..... 2005-331400

(51) Int. Cl.
*F02M 51/00* (2006.01)
*F02M 1/00* (2006.01)

(52) U.S. Cl. ..... 123/478; 123/445

(58) Field of Classification Search ..... 123/445, 123/472, 478, 480, 490; 361/154
See application file for complete search history.

(56) References Cited

U.S. PATENT DOCUMENTS 4,255,789 A * 3/1981 Hartford et al. ..... 701/108
4,416,239 A * 11/1983 Takase et al. ..... 123/406.47
4,996,954 A * 3/1991 Seki et al. ..... 123/90.16
2006/0005812 A1* 1/2006 Mashiki ..... 123/431

FOREIGN PATENT DOCUMENTS

JP 2000-303882 A 10/2000

* cited by examiner

*Primary Examiner*—John T. Kwon
(74) *Attorney, Agent, or Firm*—Sughrue Mion, PLLC

(57) ABSTRACT

Provided is a fuel injection control device for an internal combustion engine capable of setting an overexcitation current time period which allows injectors to be reliably driven even when a fuel pressure sensor is in an abnormal state. A fuel supply control portion is equipped with an injector-valve opening signal generating unit, a first driving current supply signal generating unit, a first driving current supplying unit, a second driving current supplying unit, and a fuel pressure sensor malfunction detecting unit. When a malfunction in the fuel pressure sensor is detected, the first driving current supply signal generating unit sets a first driving current supply time period to a fixed time period which allows injectors to be opened even when a fuel pressure in the internal combustion engine is at its maximum.

2 Claims, 4 Drawing Sheets

FUEL INJECTION CONTROL DEVICE

BACKGROUND OF THE INVENTION

1. Field of the Invention

The present invention relates to a fuel injection control device used in an internal combustion engine for a vehicle to drive an electromagnetic valve for fuel injection at high speed in accordance with a pressure of fuel discharged from high-pressure fuel pump.

2. Description of the Related Art

A fuel injection device for supplying fuel to an internal combustion engine for a vehicle, which is composed of a valve opening signal generating unit, a power supply control unit, a fuel pump, a main power supply, an auxiliary power supply, and the like, has been in widespread use. The valve opening signal generating unit calculates an injection amount of fuel to be supplied based on signals from a group of sensors for detecting operation states of the internal combustion engine, determines a valve opening timing and a valve closing time period for fuel injection valves, and outputs a valve opening signal. The power supply control unit applies a high voltage to an electromagnetic coil for driving the fuel injection valves in accordance with the valve opening signal outputted from the valve opening signal generating unit, and holds the fuel injection valves open through a small current after the fuel injection valves have been driven to be opened quickly. The fuel pump supplies high-pressure fuel having a variable pressure from the fuel injection valves to the internal combustion engine. The main power supply supplies a power to the group of the sensors, the power supply control unit, and the like. The auxiliary power supply raises the voltage of the main power supply, and supplies a current to the electromagnetic coil for driving the fuel injection valves when they are opened.

For example, there is a fuel injection device as disclosed in JP 2000-303882 A. This fuel injection device is equipped with a fuel pressure regulator for adjusting a fuel pressure of injected fuel, an injector driving unit for driving valve bodies of injectors to be opened and closed by energizing an electromagnetic coil for the injectors, and an injection control unit for controlling the fuel pressure regulator and the injector driving unit in accordance with a rotational speed, an intake air amount, and a fuel pressure of the internal combustion engine. The injection control unit has an injection timer for setting a time period for exciting the electromagnetic coil, an overexcitation timer for supplying an overexcitation current in an initial stage of energization, and an overexcitation period control portion for variably setting the overexcitation timer in accordance with a fuel pressure. An overexcitation period is variably set to be longer as the fuel pressure rises.

In order to enlarge the linearity of an injection amount with respect to an injection pulse time period of the injectors, it is necessary to reduce the operating time period in turning the valve bodies of the injectors ON and OFF and accurately control them to be opened and closed. The time period in which the valve bodies of the injectors are ON can be made shorter as the amount of the current increases, and the time period in which the valve bodies of the injectors are OFF can be made shorter as the amount of the current decreases. In accordance with this principle, when opening the valve bodies of the injectors, the injector driving unit supplies a predetermined overexciting current to the electromagnetic coil for driving the valve bodies of the injectors with a steep gradient, and keeps supplying the overexciting current until the operation of turning the valve bodies ON is substantially completed. On the other hand, the electromagnetic suction force of the electromagnetic coil increases after the operation of turning the valve bodies ON has been completed. Therefore, in order to maintain the valve bodies of the injectors fully open, the electromagnetic coil may be supplied with a minimum required holding current that is smaller than the overexcitation current.

However, if the time period for supplying the overexcitation current is set relatively long, the injectors are driven with a large current when being turned OFF in the case where the injection time period is short. As a result, the time period in which the valves are OFF is long. Accordingly, it is desirable to set the time period for supplying the overexcitation current as short as possible. The opening time period of the injector valves is longer as the fuel pressure rises, because of the structure of the valves. Thus, an overexcitation time period is changed in accordance with the fuel pressure, and a minimum required overexcitation time period is set to open the valves of the injectors. In consequence, optimum control is performed.

In the technology disclosed in JP 2000-303882 A, the overexcitation time period is changed in accordance with the fuel pressure, and the operating time period for turning the valve bodies of the injectors ON and OFF is shortened to accurately control the valve bodies to be opened and closed. However, the pressure of fuel supplied to the fuel injection valves cannot be accurately recognized when there is a malfunction in a fuel pressure sensor for setting the overexcitation time period. Therefore, the overexcitation time period is set inappropriately. In the worst case, the inappropriate overexcitation time period leads to a problem in that the fuel injection valves are not opened and the fuel supply is impossible.

SUMMARY OF THE INVENTION

The present invention has been made to solve the above-mentioned problem. It is an object of the present invention to provide a fuel injection control device capable of setting an overexcitation current time period allowing injectors to be reliably driven even when a fuel pressure sensor is in an abnormal state.

In order to achieve the above-mentioned object, a fuel injection device according to the present invention includes: a plurality of injectors for injecting fuel into an internal combustion engine; a fuel pressure sensor for detecting a pressure of fuel supplied to the plurality of injectors; various sensors for detecting operation states of the internal combustion engine; and a fuel supply control portion for calculating an amount of fuel supply based on a signal from the fuel pressure sensor and signals from the various sensors and for performing driving control of the plurality of injectors. In the fuel injection device, the fuel supply control portion includes: injector-valve opening signal generating means for calculating an amount of fuel supply based on the signals from the various sensors and for outputting an injector-valve opening signal for the plurality of injectors, a first driving current supply signal generating means for setting a first driving current supply time period, in which a first driving current is supplied during an injector-valve opening time period, based on the signal from the fuel pressure sensor and for outputting a first driving current supply signal; a first driving current supplying means for supplying the first driving current to the plurality of injectors based on the injector-valve opening signal from the injector-valve opening signal generating means and the first driving current supply signal from the first driving current supply signal generating means; a second driving current supplying means for supplying a second driving current, which is smaller than the first driving current, to the plurality of injectors based on the injector-valve opening signal from the injector-valve opening signal generating means after the first driving current has been supplied to the plurality of injectors; and fuel pressure sensor malfunction detecting means for detecting a malfunction in the fuel pressure sensor based on a signal from the fuel pressure sensor. The first driving current supply signal generating means sets the first driving current supply time period to a predetermined fixed time period in a case where the fuel pressure sensor malfunction detecting means has detected a malfunction in the fuel pressure sensor.

According to the present invention, the current allowing the injectors to be reliably driven can be supplied by setting the first driving current supply time period to the fixed time period in which the injectors can be opened even when the fuel pressure supplied to the injectors is at its maximum when there is a malfunction in the fuel pressure sensor.

DETAILED DESCRIPTION OF THE PREFERRED EMBODIMENT

Figure 1:
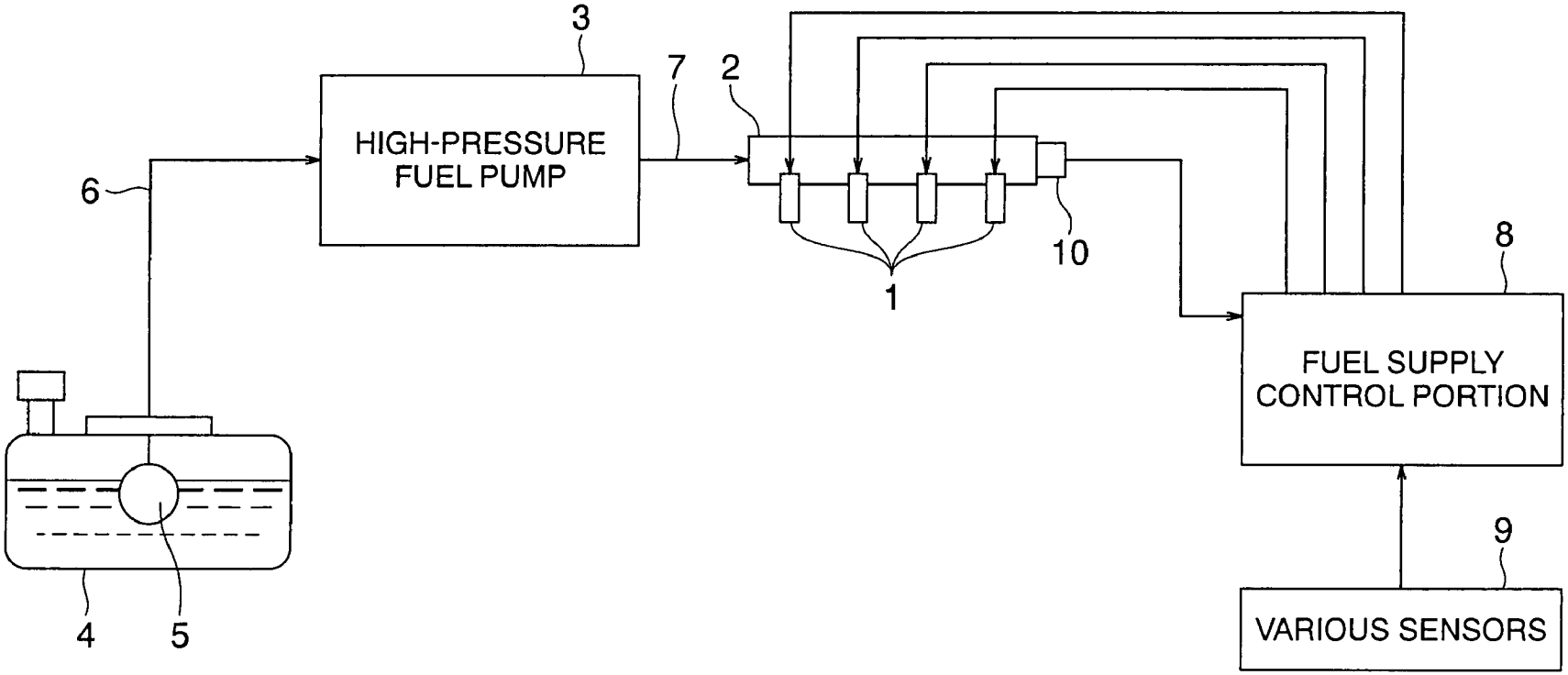
FIG. 1 is a block diagram showing a configuration of a fuel injection control device according to the present invention.

FIG. 1 is a block diagram showing a configuration of a fuel injection control device according to the present invention. The fuel injection control device shown in FIG. 1 is equipped with a plurality of injectors 1, a high-pressure fuel pump 3, a fuel tank 4, and a low-pressure feed pump 5. The injectors 1 are provided in a common fuel pipe 2 to directly inject fuel into respective cylinders of an internal combustion engine. The high-pressure fuel pump 3 supplies fuel to the injectors 1 via a high-pressure pipe 7. The fuel tank 4 stores fuel for the internal combustion engine. The low-pressure feed pump 5 supplies the fuel in the fuel tank 4 to the high-pressure fuel pump 3 via a low-pressure pipe 6. The fuel pipe 2 has functions of storing pressurized fuel supplied from the high-pressure fuel pump 3 and distributing the pressurized fuel to each of the injectors 1.

The fuel injection control device is also equipped with a fuel supply control portion 8, various sensors 9, and a fuel pressure sensor 10. The fuel supply control portion 8 controls the fuel supply to the internal combustion engine. The sensors 9 detect an engine load and a state of the internal combustion engine. The fuel pressure sensor 10 detects a fuel pressure in the fuel pipe 2. The fuel supply control portion 8 calculates an amount of fuel supply for controlling the injectors 1 based on signals from the sensors 9 and a signal from the fuel pressure sensor 10, and performs driving control of the injectors 1, thereby performing operation of the internal combustion engine.

Figure 2:
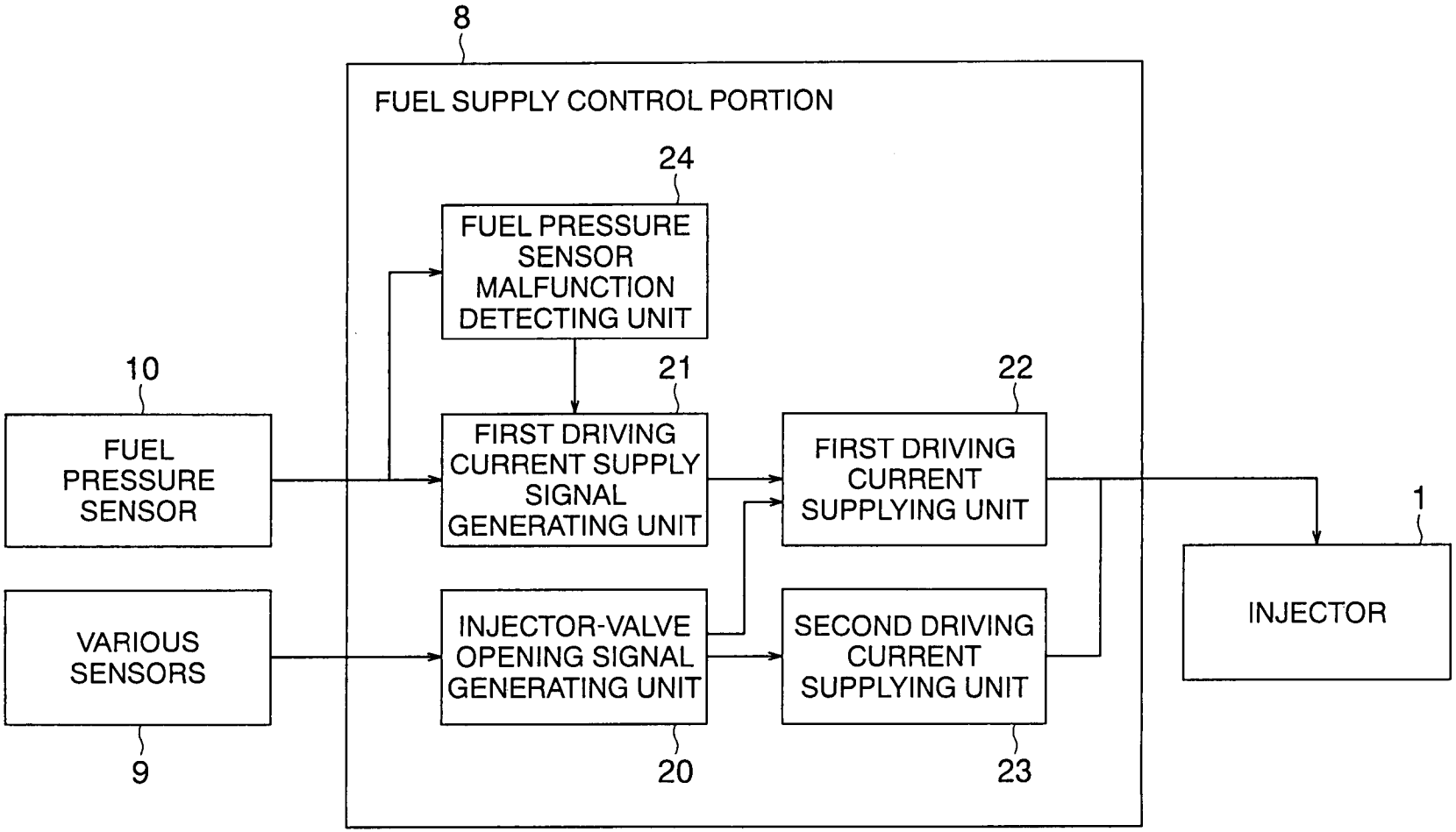
FIG. 2 is a block diagram showing a configuration inside a fuel supply control portion 8 shown in FIG. 1.

FIG. 2 is a block diagram showing a configuration inside the fuel supply control portion 8. As shown in FIG. 2, the fuel supply control portion 8 has an injector-valve opening signal generating unit 20, a first driving current supply signal generating unit 21, a first driving current supplying unit 22, a second driving current supplying unit 23, and a fuel pressure sensor malfunction detecting unit 24. The injector-valve opening signal generating unit 20 calculates an amount of fuel supply based on operational states of the internal combustion engine, using detection signals from the sensors 9, and outputs an injector-valve opening signal. The first driving current supply signal generating unit 21 sets a first driving current supply time period for supplying a first driving current at an injector-valve opening timing based on a detection signal from the fuel pressure sensor 10, and outputs a first driving current supply signal. The first driving current supplying unit 22 supplies the first driving current based on the injector-valve opening signal from the injector-valve opening signal generating unit 20 and the first driving current supply signal from the first driving current supply signal generating unit 21. The second driving current supplying unit 23 constitutes, together with the first driving current supplying unit 22, a current supplying unit for the injector 1, and supplies a second driving current, which is smaller than the first driving current, based on the injector-valve opening signal from the injector-valve opening signal generating unit 20, after the first driving current has been supplied. The fuel pressure sensor malfunction detecting unit 24 detects a malfunction in the fuel pressure sensor 10.

The fuel pressure sensor malfunction detecting unit 24 regularly monitors a detection signal from the fuel pressure sensor 10, and judges that there is a malfunction in the fuel pressure sensor 10 when the detection signal of the fuel pressure sensor 10 assumes an abnormal value. When the fuel pressure sensor malfunction detecting unit 24 detects a malfunction in the fuel pressure sensor 10, a fuel pressure sensor malfunction detection signal is transmitted to the first driving current supply signal generating unit 21. When the malfunction detection signal indicating a malfunction in the fuel pressure sensor 10 is transmitted from the fuel pressure sensor malfunction detecting unit 24, the first driving current supply signal generating unit 21 outputs a first driving current supply time period allowing the injectors 1 to be opened even when the fuel pressure in the internal combustion engine is at its maximum, instead of a first driving current supply time period set according to the malfunction detection signal indicating the malfunction in the fuel pressure sensor 10.

Figure 3A:
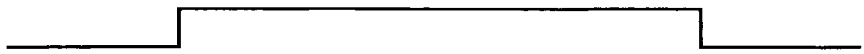
FIG. 3A is a waveform diagram showing an injector-valve opening signal.
Figure 3B:
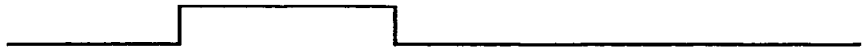
FIG. 3B is a waveform diagram showing a first driving current supply signal.
Figure 3C:
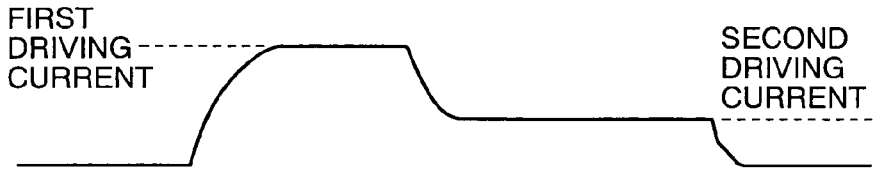
FIG. 3C is a waveform diagram showing an injector driving current.

Next, the current supply to the injectors 1 will be described with reference to FIGS. 3A to 3C. FIG. 3A shows an injector-valve opening signal from the injector-valve opening signal generating unit 20. FIG. 3B shows a first driving current supply signal from the first driving current supply signal generating unit 21. FIG. 3C shows an injector driving current supplied to the injectors 1 by the first driving current supplying unit 22 and the second driving current supplying unit 23.

As shown in FIGS. 3A to 3C, the first driving current is supplied to the injectors 1 from the first driving current supplying unit 22 based on the injector-valve opening signal from the injector-valve opening signal generating unit 20 and the first driving current supply signal from the first driving current supply signal generating unit 21. The injectors 1 are opened at high speed by the first driving current. Then, after the first driving current supply signal has been canceled, a second driving current is supplied from the second driving current supplying unit 23 based on the injector-valve opening signal. The second driving current can maintain the injectors 1 open and is smaller than the first driving current.

Figure 4:
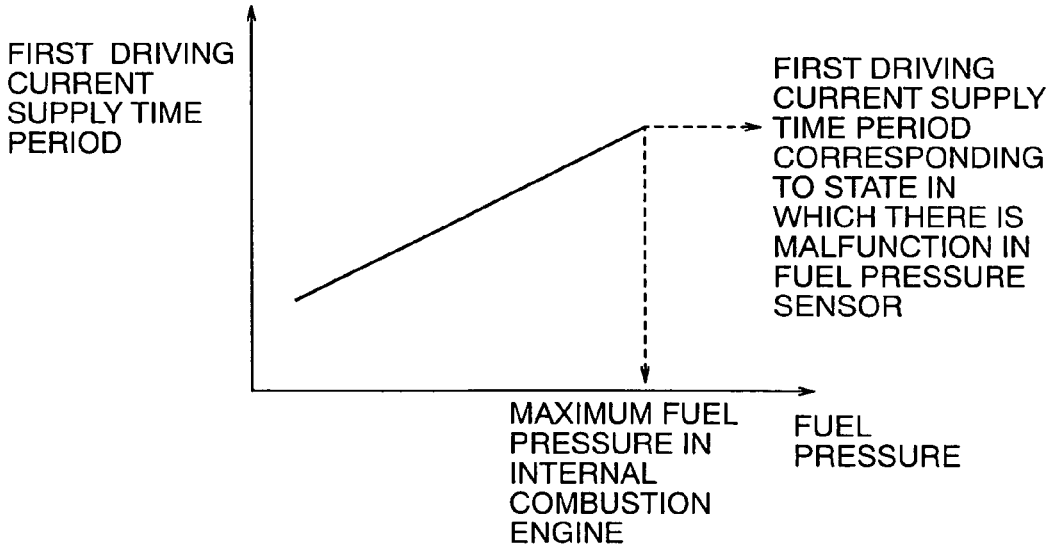
FIG. 4 is a diagram showing a relationship between a fuel pressure set in a first driving current supply signal generating unit 21 and the first driving current supply signal.

FIG. 4 shows a relationship between a fuel pressure set in the first driving current supply signal generating unit 21 and the first driving current supply signal. The time period in which the first driving current supply signal is outputted increases as the fuel pressure rises. This is because the valve opening time period of the injectors 1 changes depending on the fuel pressure because of the structure of the valves of the injectors, and increases as the fuel pressure rises. The first driving current supply signal generating unit 21 supplies a minimum required first driving current for opening the injectors 1 to thereby ensure the responsiveness at the time of cancellation of the first driving current supply signal, and sets an optimum overexcitation time period at each fuel pressure according to the relationship shown in FIG. 4 to suppress the amount of consumed current.

Now, a description will be given as to a case where there is a malfunction in the fuel pressure sensor 10. If there is a malfunction in the fuel pressure sensor 10, the first driving current supply time period is set to a fixed value allowing the injectors 1 to be opened even when the fuel pressure in the internal combustion engine is at its maximum, as shown in FIG. 4. When there is a malfunction in the fuel pressure sensor 10, the pressure of fuel supplied to the injectors 1 cannot be accurately recognized by a detection signal from the fuel pressure sensor 10. Thus, the first driving current supply, which is set in accordance with the detection signal from the fuel pressure sensor 10, assumes an inappropriate value. In the worst case, the injectors 1 are not opened and the fuel supply is impossible. In order to avoid this situation, in the case where the fuel pressure sensor malfunction detecting unit 24 has detected a malfunction in the fuel pressure sensor 10 and outputted a fuel pressure sensor malfunction signal, the first driving current supply time period is set to the fixed value.

Figure 5:
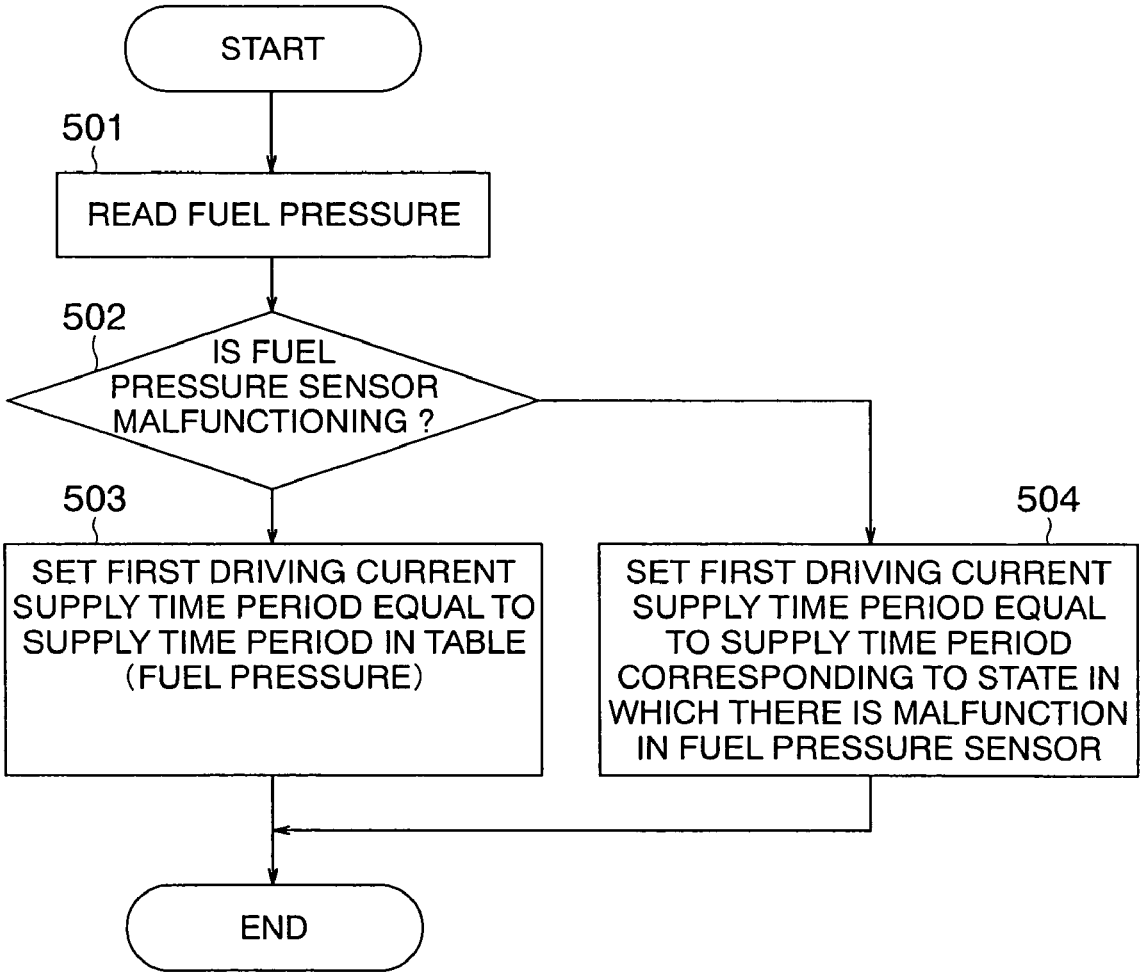
FIG. 5 is a flowchart showing how a first driving current supply time period is set by the first driving current supply signal generating unit 24.

Next, the setting of a first driving current supply time period performed by the first driving current supply signal generating unit 21 will be described with reference to a flowchart shown in FIG. 5. First in a step S501, a fuel pressure is read from a detection signal of the fuel pressure sensor 10. Then, the step advances to a step S502 to confirm whether or not it is determined, through a malfunction detection signal of the fuel pressure sensor 10 obtained from the fuel sensor malfunction detecting unit 24, that there is a malfunction in the fuel pressure sensor 10. When there is no malfunction in the fuel pressure sensor 10, the step advances to a step S503 to set a first driving current supply time period according to a data table having an axis indicating a fuel pressure. When there is a malfunction in the fuel pressure sensor 10 in the step S502, the step advances to a step S504 to set a first driving current supply time period corresponding to a state in which there is a malfunction in the fuel pressure sensor 10.

According to the foregoing measure, in a system in which the first driving current supply time period is optimized using the detection signal of the fuel pressure sensor 10, the current allowing the injectors 1 to be reliably driven can be supplied even when there is a malfunction in the fuel pressure sensor 10.

Thus, according to the aforementioned embodiment of the present invention, the current allowing the injectors 1 to be reliably driven can be supplied by setting the first driving current supply time period to a fixed time period which allows the injectors 1 to be opened even when the pressure of fuel supplied to the injectors 1 is at its maximum when there is a malfunction in the fuel pressure sensor 10.

What is claimed is:

1. A fuel injection control device comprising:

a plurality of injectors for injecting fuel into an internal combustion engine;

a fuel pressure sensor for detecting a pressure of fuel supplied to the plurality of injectors;

various sensors for detecting operation states of the internal combustion engine; and a fuel supply control portion for calculating an amount of fuel supply based on a signal from the fuel pressure sensor and signals from the various sensors and for performing driving control of the plurality of injectors, wherein the fuel supply control portion comprises:

injector-valve opening signal generating means for calculating an amount of fuel supply based on the signals from the various sensors and for outputting an injector-valve opening signal for the plurality of injectors;

a first driving current supply signal generating means for setting a first driving current supply time period, in which a first driving current is supplied during an injector-valve opening time period, based on the signal from the fuel pressure sensor and for outputting a first driving current supply signal;

a first driving current supplying means for supplying the first driving current to the plurality of injectors based on the injector-valve opening signal from the injector-valve opening signal generating means and the first driving current supply signal from the first driving current supply signal generating means;

a second driving current supplying means for supplying a second driving current, which is smaller than the first driving current, to the plurality of injectors based on the injector-valve opening signal from the injector-valve opening signal generating means after the first driving current has been supplied to the plurality of injectors; and fuel pressure sensor malfunction detecting means for detecting a malfunction in the fuel pressure sensor based on a signal from the fuel pressure sensor, and wherein the first driving current supply signal generating means sets the first driving current supply time period to a predetermined fixed time period in a case where the fuel pressure sensor malfunction detecting means has detected a malfunction in the fuel pressure sensor.

2. The fuel injection control device according to claim 1, wherein the first driving current supply signal generating means sets the first driving current supply time period to a time period allowing the plurality of injectors to be opened even when a fuel pressure in the internal combustion engine is at a maximum, if the fuel pressure sensor malfunction detecting means has detected a malfunction in the fuel pressure sensor.

* * * * *